US006398146B1

(12) United States Patent
Cattaneo

(10) Patent No.: US 6,398,146 B1
(45) Date of Patent: Jun. 4, 2002

(54) DEVICE FOR MANEUVERING A SHUTTER OR ROLLER-TYPE CLOSURE MEMBER AND PROCESS FOR MANUFACTURING SUCH A CLOSURE MEMBER

(75) Inventor: Rino Cattaneo, Vedano Al Lambro (IT)

(73) Assignee: Simbac S.p.A., Mezzago (IT)

( * ) Notice: Subject to any disclaimer, the term of this patent is extended or adjusted under 35 U.S.C. 154(b) by 11 days.

(21) Appl. No.: 09/588,700

(22) Filed: Jun. 7, 2000

(30) Foreign Application Priority Data

Jun. 9, 1999 (FR) ..... 99 07509

(51) Int. Cl.[7] ..... B65H 75/48

(52) U.S. Cl. ..... 242/379.2; 242/597.8; 242/170; 242/598.6; 242/379; 242/401; 242/405

(58) Field of Search ..... 242/597.8, 170, 242/598.6, 596.8, 379.2, 379, 401, 405, 395

(56) References Cited

U.S. PATENT DOCUMENTS 2,575,354 A * 11/1951 Mills
5,279,473 A * 1/1994 Rozon ..... 242/107.12
5,354,011 A * 10/1994 Rozon ..... 242/402
5,553,650 A * 9/1996 Jelic ..... 160/178.1
5,630,456 A * 5/1997 Hugo et al. ..... 160/173
5,918,658 A * 7/1999 Schartner ..... 160/178.1 R

FOREIGN PATENT DOCUMENTS

| | | |
|---|---|---|
| EP | 0670409 | 9/1995 |
| FR | 1461101 | 2/1967 |
| LU | 47207 | 12/1964 |
| LU | 54117 | 9/1967 |

* cited by examiner

*Primary Examiner*—Donald P. Walsh
*Assistant Examiner*—Jonathan R Miller
(74) *Attorney, Agent, or Firm*—Dowell & Dowell, P.C.

(57) ABSTRACT

A device for winding a strap or strip of material for maneuvering a shutter, roller blind or equivalent device comprising a member for winding and tensioning the strap disposed inside a box formed by two shells each including at least one edging extending in a direction substantially perpendicular to a principal web of each shell. The edgings are adapted to be brought into mutual engagement by a relative translation in a direction substantially parallel to the respective principal webs of the shells, in a configuration where an edging of a first shell is covered by an edging of a second shell.

10 Claims, 4 Drawing Sheets

DEVICE FOR MANEUVERING A SHUTTER OR ROLLER-TYPE CLOSURE MEMBER AND PROCESS FOR MANUFACTURING SUCH A CLOSURE MEMBER

BACKGROUND OF THE INVENTION

The present invention relates to a strap winding device, to a mechanism for maneuvering a shutter, roller blind or the like comprising such a winding device, and to a process for manufacturing such a winding device.

DESCRIPTION OF THE RELATED ART

It is known to use a belt, strap or any other flexible tie to maneuver a shutter or roller blind and, more generally, for any device comprising a shutter adapted to be selectively wound on a shaft in order to obturate, or not, an opening such as a window or door of a building.

In order to avoid such a belt or strap hanging down towards the ground, in particular when the shutter is in wound configuration, it is provided to arrange a strap winding device near such an opening, this device comprising a member for tensioning this strap by automatic winding inside the winding device. For example, EP-A-0 812 795 discloses a strap winding device comprising a spring box disposed inside a body formed by two shells articulated around a hinge and provided to clip on each other by rotation about the axis of this hinge. When this winding device is in mounted position, there remains a slot for connection between these two shells, the width of this slot not being controllable with precision due to the usual manufacturing tolerances for this type of device. Dirt tends to accumulate in this slot, which is both unaesthetic and potentially pathogenic. In addition, such a winding device, which is disposed near an opening, is subjected to variations in temperature of considerable amplitude, in particular as a function of its exposure to the sun. It is not rare for the shells which are subjected to different thermal stresses depending on their exposure, to be deformed to such a point that said slot gapes, which adds to the drawbacks set forth hereinabove. Finally, the production of a hinge requires complex tools and substantially increases the cost price of the box of the known winding device.

It is a particular object of the present invention to overcome these drawbacks by proposing a strap winding device whose box is formed simply and therefore reliably, and without creating an unsightly slot in which dirt can accumulate.

SUMMARY OF THE INVENTION

To that end, the invention relates to a device for winding a strap, flexible strip of material or the like for maneuvering a shutter, roller blind or equivalent closure member for obturating an opening, this device comprising a member for winding and tensioning the strap disposed inside a box formed by two shells each comprising at least one edging extending in a direction substantially perpendicular to a principal web of each shell, characterized in that these edgings are adapted to be brought into mutual engagement by a relative translation in a direction substantially parallel to the respective principal webs of the shells, in a configuration where a first edging of a first shell is covered by a second edging of the second shell.

Thanks to the invention, it is unnecessary to use a hinge for assembling the box of the winding device. On the other hand, as, in assembled configuration, one edging surrounds the other edging, the outer surface of the outer edging forms a uniform visible surface of the box, without slot or opening.

According to advantageous characteristics of the invention, the winding device incorporates one or more of the following features:

- The edgings each extend in at least two substantially perpendicular directions. This allows a relative immobilization of the two shells to be obtained by cooperation of shapes of the edgings, parallel to these two directions.
- The outer surface of the first edging is provided with elements in relief adapted to coooperate with corresponding elements in relief formed on the inner surface of the second edging for the assembly of the shells. These elements in relief, which may include grooves and ribs of corresponding profiles, allow a sufficient engagement of the edgings to avoid the shells coming apart.
- The shells present a substantially rectilinear edge and a concave edge whose concavity, in assembled configuration of the box, faces towards the tensioning member, the edgings extending, at the level of this concave edge, over an angular sector with an apex angle greater than or equal to 180°.
- One of the shells comprises a second edging extending in the direction substantially perpendicular to the direction of relative translation of the shells and provided with at least one housing for receiving a stud borne by the other shell. This makes it possible to obtain an additional relative immobilization of the two shells forming the box.
- One of the shells bears an elastic lock adapted to cooperate with a corresponding part of the other shell in order to lock the shells when the box is in assembled configuration. In that case, this lock is advantageously formed on an edge of the shell provided to be oriented towards a partition in the vicinity of which the winding device is adapted to be mounted, this lock being masked by the winding device in normal position of use. Thanks to this aspect of the invention, the lock is not directly accessible for a user who does not know the existence of it, for example a child, while a professional may have access to it by pivoting the winding device or sliding his fingers between the winder and the partition. In addition, the lock may be provided to be formed by an elastically deformable tongue extending in a direction substantially perpendicular to the direction of relative translation of the shells.

The invention also relates to a mechanism for maneuvering a shutter, roller blind or the like which comprises a strap winding device as described hereinabove. Such a mechanism is more economical and easier to install than known devices.

Finally, the invention relates to a process for manufacturing a winding device as described hereinabove and, more specifically, a process which consists in:

- moulding two shells each provided with a principal web and an edging extending in a direction substantially perpendicular to this web;
- equipping one of these shells with fixing elements and/or a brake for the strap, particularly by riveting;
- assembling the shells, causing them to undergo a movement of relative translation in a direction substantially parallel to their respective principal webs, and
- locking the shells together by cooperation of shapes of the edgings.

BRIEF DESCRIPTION OF THE DRAWINGS

The invention will be more readily understood on reading the following description of a strap winding device in accordance with its principle, given solely by way of example and made with reference to the accompanying drawings, in which.

DESCRIPTION OF PREFERRED EMBODIMENT

Figure 1:
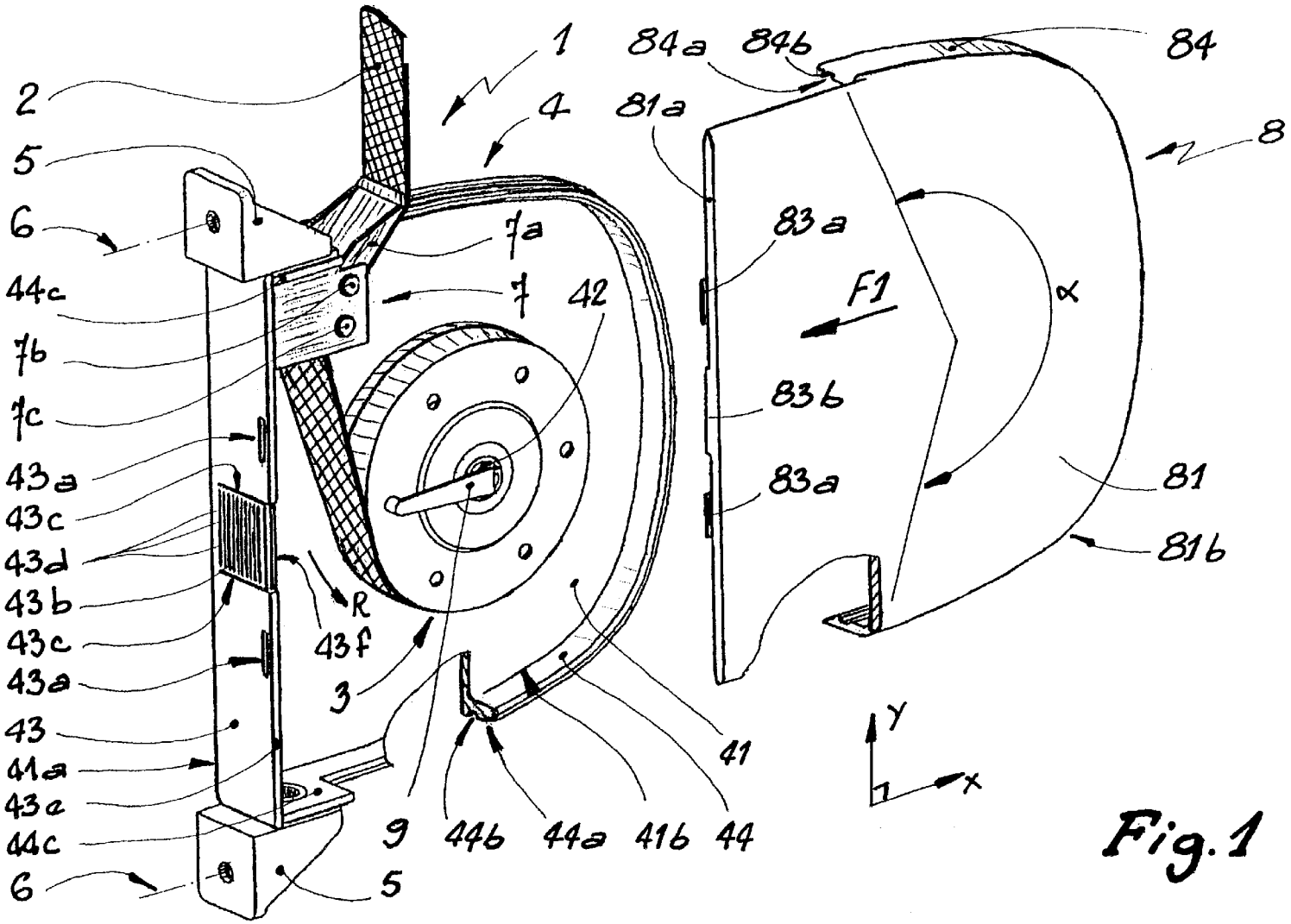
FIG. 1 is a view in perspective of a strap winding device according to the invention in the course of assembly.

Referring now to the drawings, the winding device 1 shown in the Figures is intended to maintain taut a strap or flexible tie 2 for maneuvering a winding shaft of a shutter, roller blind or equivalent closure member for obturating an opening through which light can pass. A spring box 3 is provided to exert on the strap 2 an elastic effort tending to wind the strap 2 around the box 3 in the direction of arrow R in FIG. 1.

The box 3 is mounted on a shell 4 made of plastics material comprising a principal web 41 in the central part of which there is formed, integral therewith, a shaft 42 for centering the box 3. The web 41 comprises a substantially rectilinear edge 41*a* and a concave edge 41*b* whose concavity is turned towards the shaft 42 and the box 3.

At the level of edge 41*a*, the web 41 extends in a substantially rectilinear edging 43 perpendicular to web 41. Similarly, an edging 44 extends at the level of edge 41*b* of the web 41, perpendicularly to said web, the edgings 43 and 44 extending on the same side with respect to the web 41.

The edging 43 is provided with two elongated orifices 43*a* substantially parallel to edge 41*a*. A tongue 43*b* is also formed in the edging 43 thanks to two slots 43*c* substantially perpendicular to the edge 41*a*. The outer surface of the tongue 43*b*, i.e. its surface turned away from the box 3, is fluted or striated (43*d*).

The outer surface 44*a* of the edging 44 is provided with a groove 44*b* substantially parallel to the edge 41*b* of the principal web 41.

Near the edging 43, the edging 44 widens and forms two tabs 44*c* on which are riveted brackets 5 allowing the winding device 1 to be mounted on a vertical partition thanks to screws represented by lines 6 indicating their respective axes. A brake 7 is also mounted in the upper part of the edging 43 and against the upper tab 44*c* of the edging 44, being riveted on the tab 44*c* with the corresponding bracket 5. The brake 7 comprises a cam 7*a* articulated about a pin 7*b* and adapted to cooperate with a second pin 7*c* in order to block the strap 2 when it extends in a substantially vertical direction, as shown in FIG. 1.

All the elements 3 to 7, which are borne by the shell 4, allow the winding device to function, these elements 3 and 7 having to be protected from the ambient atmosphere.

To that end, another shell 8 is made from plastics material and comprises a principal web 81 of shape similar to web 41 and likewise comprising a rectilinear edge 81*a* and a concave edge 81*b*. The edge 81*a* of the web 81 is provided with two studs 83*a* of elongated shape corresponding to that of the orifices 43*a*. A small-dimension return 83*b* extends transversely with respect to the edge 81*a* in the central part thereof. The concave edge 81*b* of the web 81 bears an edging 84 extending in a direction substantially perpendicular to the web 81 over the major part of the edge 81*b*.

The inner surface 84*a* of the edging 84, i.e. the surface turned towards the web 81, is provided with a rib 84*b* whose profile corresponds to that of the groove 44*b* of the edging 44. In fact, as is visible in FIG. 5, the profiles of surfaces 44*a* and 84*a* are complementary.

According to the invention, shell 8 is provided to be mounted on shell 4 by a movement of translation parallel to webs 41 and 81, represented by arrow $F_1$ in FIG. 1. The effect of this movement is to bring together edges 41*a* and 81*a*, on the one hand, and 41*b*, 81*b*, on the other hand, edging 84 surrounding edging 44 to the point of masking this edging virtually completely, as shown in FIG. 2.

Figure 2:
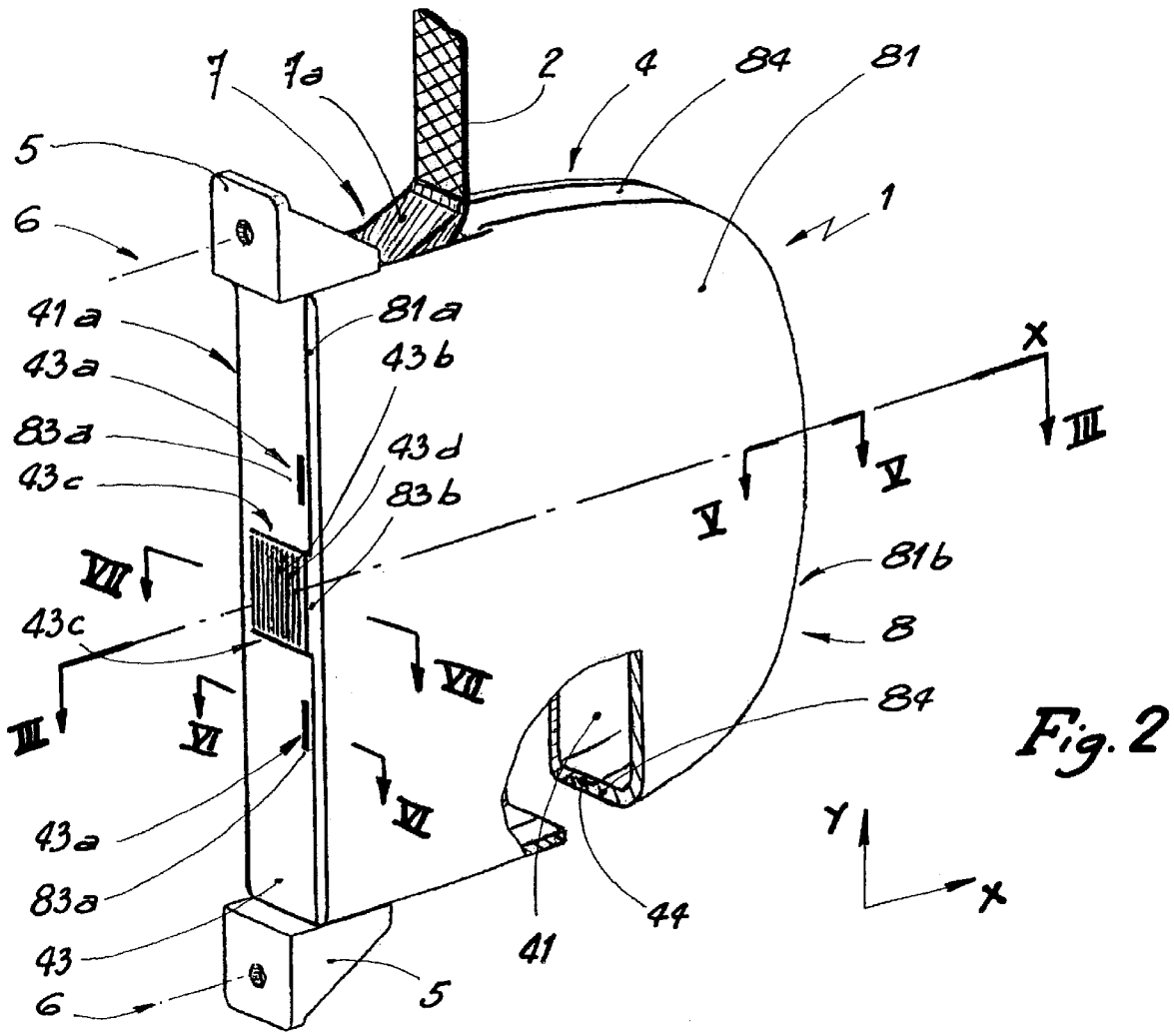
FIG. 2 is a view in perspective with parts torn away of the winding device of FIG. 1 in assembled configuration.

In the assembled position shown in FIG. 2, the winding device constitutes a closed assembly and the studs 83*a* have penetrated in the orifices 43*a*, while the return 83*b* has passed beyond tongue 43*b*, with the result that said tongue is blocked inside said return.

Figure 3:
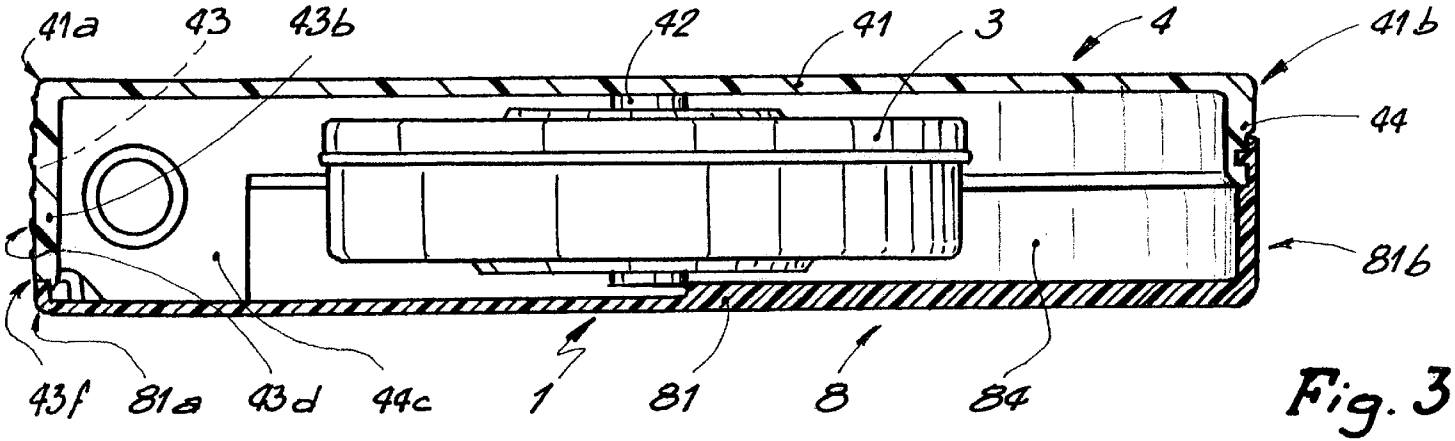
FIG. 3 is a section along line III—III of FIG. 2, the strap and the lower bracket of the device not being shown.
Figure 4:
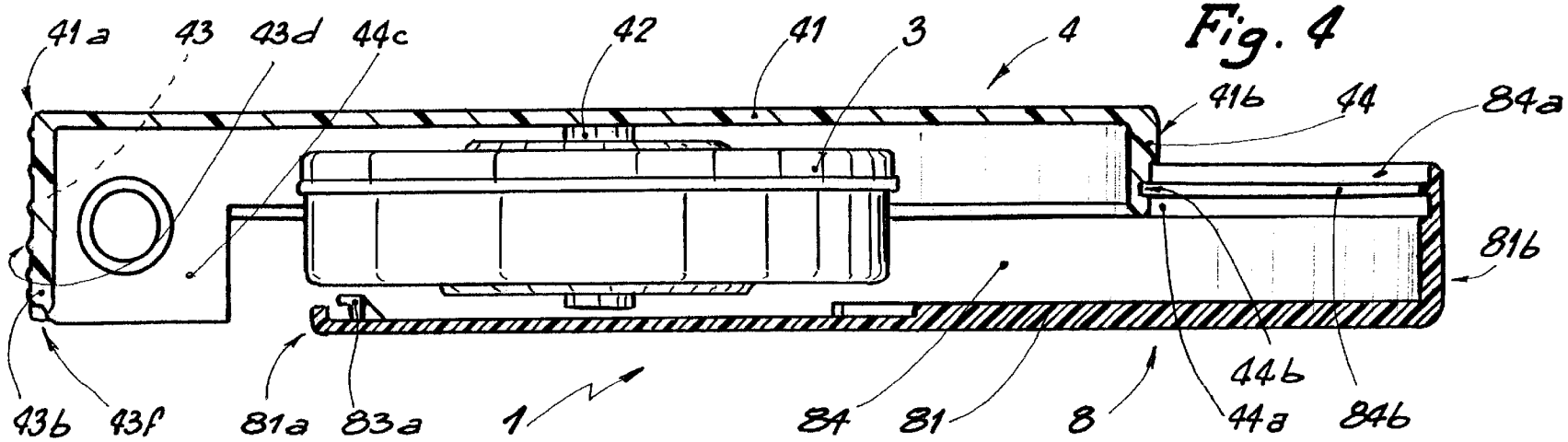
FIG. 4 is a section similar to FIG. 3 while the winding device is being assembled, in an intermediate configuration between those of FIGS. 1 and 2.

As is more particularly visible on comparing FIGS. 3 and 4, the groove 44*b* and the rib 84*b* cooperate in order to guide the movement of translation in the direction of arrow $F_1$, as shown in FIG. 4 and to efficiently lock the edgings 44 and 84 together, as shown in the position of FIG. 3.

Figure 5:
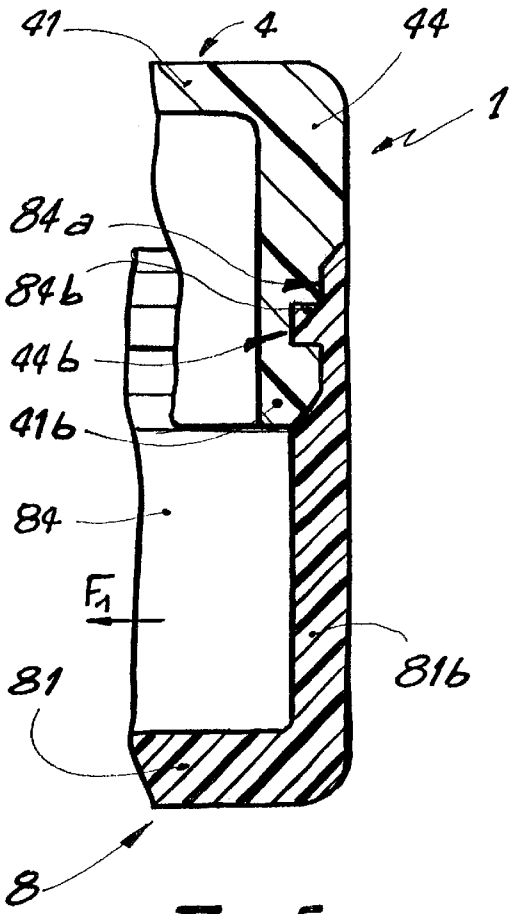
FIG. 5 is a section on a larger scale along line V—V of FIG. 2.

The cooperation of the profiles of surfaces 44*a* and 84*a* is more particularly visible in FIG. 5.

The edges 41*b* and 81*b* of the principal webs extend in a direction X substantially parallel to arrow $F_1$ and in a direction Y substantially perpendicular to this arrow. In this way, the edgings 44 and 84 extend in two directions, so that, when one of them is in abutment against the other, a relative immobilization of shells 4 and 8 in both directions X and Y is obtained. In other words, the non-rectilinear nature of the edgings 44 and 84 ensures a good immobilization of the shells 4 and 8 with respect to each other.

The edgings 44 and 84 extend around shaft 42 over an angular sector with apex angle $\alpha$ of the order of 220°, which means that these edgings cooperate over more than half the circumference of the box thus formed, seen from shaft 42.

Figure 6:
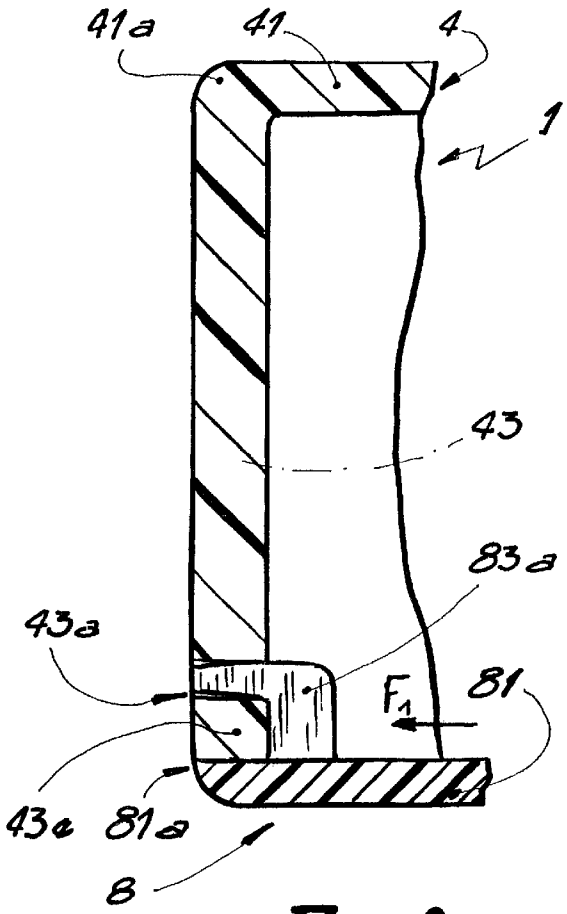
FIG. 6 is a section on a larger scale along line VI—VI of FIG. 2.

As is more clearly visible in FIG. 6, the studs 83*a* of the edge 81*a* engage in the orifices 43*a* of the edging 43, which avoids an untimely opening of the box formed by shells 4 and 8 between the free edge 43*e* of the edging 43 and the edge 81*a*. The studs 83*a* thus prevent an inward deformation of the edge 81*a* when the winding device is in mounted configuration.

Figure 7:
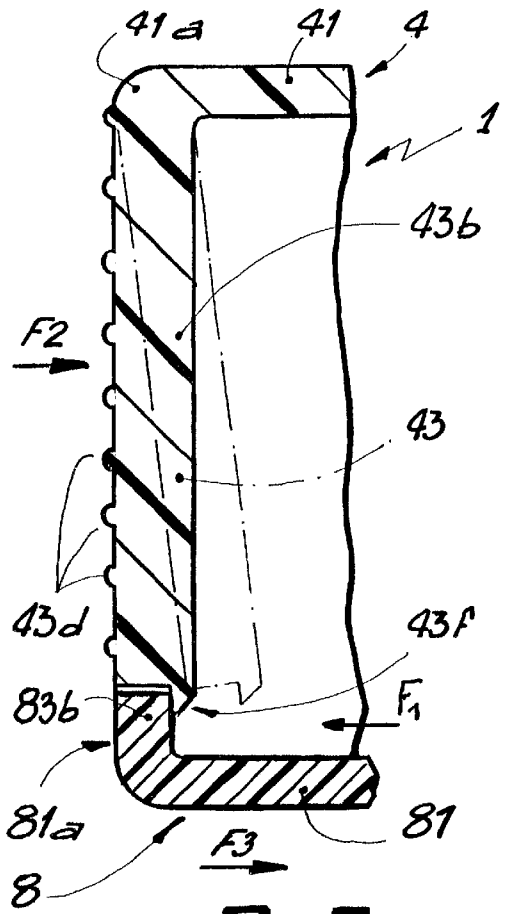
FIG. 7 is a section on a larger scale along line VII—VII of FIG. 2.

As is visible in FIG. 7, a beak 43*f* of the tongue 43 is provided to pass beyond the return 83*b* thanks to a bevelled face turned towards the interior of the shell 4. In this position, the tongue 43 performs the role of an elastic lock, as it opposes a movement of the shell 8 in the direction opposite arrow $F_1$.

When it is necessary to open the box formed by shells 4 and 8, it suffices to exert on the tongue 43*b* an effort, represented by arrow $F_2$ in FIG. 7, such that the tongue 43*b* attains the position shown in dashed and dotted lines in which the beak 43*f* no longer opposes the movement of translation $F_3$ of the shell 8.

The winding device 1 may be assembled automatically insofar as the riveting of the brackets 5 and of the brake 7 on the tabs 44*c* may be carried out by a first manipulator, while the setting and positioning of the box 3 on the shaft 42 may also be automated. The second shell 8 is then positioned on the shell 4 and the winding device may be packed and dispatched.

On the site of installation, the user fixes the winding device on the frame of an opening thanks to brackets 5 and releases shell 8 in order to access the spring box 3. It then suffices to connect the lower end of the strap 2 with the box 3 and to remove a clip 9 immobilizing this box before sliding the shell 8 in the direction of the arrow $F_1$, in order to close the box formed by shells 4 and 8, the end of the movement of the shell 8 resulting in a locking of the box in closed configuration by cooperation of shapes of elements 43*a*, 43*b*, 83*a* and 83*b*.

Taking into account the usual orientation of the brackets 5, the edging 43 of the shell 4 is intended to face the partition against which the winding device 1 is mounted. This has the consequence that the tongue 43*b* and the orifices 43*a* are not immediately accessible, in particular for a child, which avoids the risks of an unauthorized opening. When a professional wishes to open the box formed by shells 4 and 8, it suffices to pivot the shell 4 about the articulation formed by the rivets fixing the brackets 5 in order to access the tongue 43*b* on which he may exert an effort of retraction of the beak 43*f*, as represented by arrow $F_2$ in FIG. 7.

The invention has been shown with the shell 4 bearing the elastic lock 43*b*. However, such a lock might be provided on the shell 8 without departing from the scope of the present invention.

In any case, the winding device of the invention is aesthetically harmonious without a slot capable of opening at the level of its edge and the assembly holding well in time, while the two shells used are easily obtained by moulding without using complex moulds, such as slide moulds. Finally, the winding device of the invention may be assembled automatically, this allowing its cost price to be substantially reduced.

What is claimed is:

1. A device for winding a flexible strip of material for opening and closing a closure member for obturating a structural opening, said device comprising a member for winding and tensioning said flexible strip, said member being disposed inside a box formed by two shells each including at least one edging extending in a direction substantially perpendicular to a principal web of each shell, wherein said edgings are adapted to be brought into mutual engagement by a relative translation relative to one another in a direction substantially parallel to the respective principal webs of said shells, in a configuration where a first edging of a first shell is covered by a second edging of a second shell.

2. The winding device of claim 1, wherein each of said first and second shells includes edgings which extend in at least two substantially perpendicular directions.

3. The winding device of claim 1, wherein an outer surface of said first edging is provided with elements in relief adapted to cooperate with corresponding elements in relief formed on an inner surface of said second edging for assembling said first and second shells.

4. The winding device of claim 1, wherein each of said first and second shells has a substantially rectilinear edge and a concave edge whose concavity, in an assembled configuration of the box, faces towards the member for winding and tensioning, said rectilinear and concave edgings extending at said concave edge, over an angular section with an apex angle greater than or equal to 180°.

5. The winding device of claim 1, wherein one of said first and second shells includes a second edging extending in a direction substantially perpendicular to said direction of relative translation of said first and second shells and provided with at least one housing for receiving a stud carried by the other of said first and second shells.

6. The winding device of claim 1, wherein one of said first and second shells includes an elastic lock adapted to cooperate with a corresponding part of the other of said first and second shells in order to lock said first and second shells when the box is in an assembled configuration.

7. The winding device of claim 6, wherein said elastic lock is formed on an edge of said one shell provided to be oriented towards a partition in a vicinity of which the winding device is adapted to be mounted, such that said elastic lock is masked by the winding device in a position of use.

8. The winding device of claim 6, wherein said elastic lock is formed by an elastically deformable tongue extending in a direction substantially perpendicular to said direction of relative translation of the first and second shells.

9. Mechanism for opening and closing a closure member for obturating a structural opening including the winding device of claim 1.

10. Process for manufacturing a device for winding a flexible strip of material for opening and closing a closure member for obturating a structural opening and which includes a member for winding and tensioning said flexible strip of material and two shells adapted to be assembled to form a box of the winding device, wherein it comprises the steps of:

molding two shells each provided with a principal web and an edging extending in a direction substantially perpendicular to said web;

equipping one of said shells with a brake for said flexible strip of material;

assembling said shells, causing them to undergo a movement of relative translation in a direction substantially parallel to their respective principal webs, and locking said shells together by cooperation of engagement of said edgings.

* * * * *